US008230844B2

(12) United States Patent
Schill et al.

(10) Patent No.: US 8,230,844 B2
(45) Date of Patent: Jul. 31, 2012

(54) DEVICE FOR EXHAUST GAS RECIRCULATION AND PROCESS FOR MANUFACTURING IT

(75) Inventors: Andreas Schill, Stutensee (DE); Bernhard Hörner, Hockenheim (DE); Harald Timm, Weingarten (DE)

(73) Assignee: BOA Balg-und Kompensatoren-Technologie GmbH, Stutensee (DE)

( * ) Notice: Subject to any disclaimer, the term of this patent is extended or adjusted under 35 U.S.C. 154(b) by 715 days.

(21) Appl. No.: 12/407,203

(22) Filed: Mar. 19, 2009

(65) Prior Publication Data

US 2009/0235906 A1 Sep. 24, 2009

(30) Foreign Application Priority Data

Mar. 20, 2008 (DE) ..... 10 2008 015 223

(51) Int. Cl.
*F02M 25/07* (2006.01)
*F02B 47/08* (2006.01)

(52) U.S. Cl. ..... 123/568.17

(58) Field of Classification Search ..... 123/568.11, 123/568.17–568.19; 29/890.142
See application file for complete search history.

(56) References Cited

U.S. PATENT DOCUMENTS

| | | | | |
|---|---|---|---|---|
| 5,785,034 | A * | 7/1998 | Moedinger et al. | 123/568.18 |
| 6,223,733 | B1 * | 5/2001 | Busato et al. | 123/568.18 |
| 6,293,265 | B1 * | 9/2001 | Gagnon | 123/568.17 |
| 6,513,508 | B2 * | 2/2003 | Fischer et al. | 123/568.17 |
| 7,032,578 | B2 * | 4/2006 | Liu et al. | 123/568.17 |
| 7,287,523 | B1 * | 10/2007 | Fonville | 123/568.18 |

FOREIGN PATENT DOCUMENTS

DE 102005019776 11/2006

* cited by examiner

*Primary Examiner* — Willis Wolfe, Jr.
(74) *Attorney, Agent, or Firm* — McGlew and Tuttle, P.C.

(57) ABSTRACT

The invention involves a device for exhaust gas recirculation of a combustion engine, with an intake module and an exhaust gas recirculation tube projecting with its gas outlet end into the intake module. Openings are created in the peripheral wall of the gas outlet end of the exhaust gas recirculation tube so that the device is easier to manufacture, wherein peripheral wall parts stay in place as bars to which a baffle plate is coupled for the exhaust gas stream.

18 Claims, 6 Drawing Sheets

20
10
6
14
16
10
2

20
12
16
10
4
10
8
2

16
28
22
10
16
22
28
10
8
2

12
16
28
22
10
6
8
2

DEVICE FOR EXHAUST GAS RECIRCULATION AND PROCESS FOR MANUFACTURING IT

FIELD OF THE INVENTION

The invention involves a device for exhaust gas recirculation of a combustion engine, with an intake module and an exhaust gas recirculation tube projecting with its gas outlet end into the intake module.

Furthermore, the invention involves a process for manufacturing an exhaust gas recirculation device of this type.

BACKGROUND OF THE INVENTION

As is well known, exhaust gas recirculation is performed in combustion engines in motor vehicles to increase or optimize performance. In the process, the exhaust gas is recirculated into an intake module arranged on the engine block via which fresh air is sucked in and distributed to the individual cylinders. The exhaust gas recirculation is performed in such a way here that the outlet end of the exhaust gas recirculation tube is introduced into the module at a finite angle, especially perpendicular, to the direction of flow of the air duct. The housing wall of the intake module is located opposite, and not very far away from, the gas outlet end of the exhaust gas recirculation tube. Whereas the exhaust gas line and likewise the exhaust gas recirculation (EGR) line are comprised of a high-quality material, such as stainless steel, in particular, to withstand the high temperatures of the exhaust gas, the aim is to make parts of the intake module or the intake manifold, especially the housing, out of more economical materials that do not have the high thermal stability of stainless steel, for example.

Plastic is also used for this, in particular, which can in fact be heat-resistant per se, but cannot withstand the high exhaust gas temperatures without damage. The recirculated, hot exhaust gas is naturally not permitted in that case to directly come into contact with the wall of the intake module.

That is why an outlet element made up of a series of individual parts, including a baffle plate that prevents the flow of hot exhaust gas from coming into contact with the wall of the intake module after leaving the gas outlet end of the exhaust gas recirculation tube, is attached to the gas outlet end of the exhaust gas recirculation tube in accordance with the prior art. The production of the outlet element and its attachment to the gas outlet end of the exhaust gas recirculation tube are expensive, though.

This invention is based on the problem of creating a generic device for exhaust gas recirculation that is easier to manufacture. Furthermore, the invention is based on the problem of specifying a simplified manufacturing process for a device for exhaust gas recirculation.

SUMMARY OF THE INVENTION

The above-mentioned problem is solved in accordance with the invention with a generic device characterized in that openings are created in the peripheral wall of the gas outlet end of the exhaust gas recirculation tube, wherein peripheral wall parts stay in place as bars to which a baffle plate for the exhaust gas stream is coupled.

In accordance with an especially favorable embodiment of the invention, the baffle plate is a separate component and bonded to the free ends of the bars. In the process, the baffle plate could be soldered or welded to the free ends of the bars in a further favorable embodiment.

The advantages of this device in accordance with the invention especially involve the fact that the baffle plate, which can be directly put on the gas outlet end of the exhaust gas recirculation tube, is needed as the only other separate part. Other separate components that have to be attached to the exhaust gas recirculation tube are not required.

Another very favorable development of a device in accordance with the invention for recirculating exhaust gas is characterized in that the baffle plate comprises at least one part that is partially detached from the peripheral wall and that remains connected to the peripheral wall at a bending point.

The advantage of this variation of the device in accordance with the invention involves the fact that now the baffle plate also no longer has to be put on the gas outlet end of the exhaust gas recirculation tube as a separate part; instead, this is directly formed out of the tube wall of the exhaust gas recirculation tube. A joining operation to connect the baffle plate to the gas outlet end of the exhaust gas recirculation tube is no longer required because of the fact that it remains connected to the peripheral wall at a bending point. A device in accordance with the invention for exhaust gas recirculation according to this variation can therefore be manufactured in an especially simple and cost-effective way.

Another favorable development of the invention is characterized in that the part that is partially detached from the peripheral wall is bent away from the peripheral wall towards the gas outlet end of the exhaust gas recirculation tube in such a way that it acts as a baffle plate. The openings in accordance with the invention automatically arise with the partial detachment of the part from the peripheral wall of the tube; the peripheral wall parts stay in place as bars in the process. The hot exhaust gas can escape through the gaps between the bars, the gas is then guided through the baffle plate in such a way that it will not come into contact with the opposite wall of the intake module.

According to a further favorable embodiment, the peripheral wall has a limit stop for the detached part of the peripheral wall that constitutes the baffle plate.

According to a further preferred development, a retaining tab for holding the detached and bent part of the peripheral wall is provided on the side opposite the bending point. This prevents the part of the peripheral wall that acts as a baffle plate after the bending from being away by the pressure of the hot exhaust gas flowing against it.

According to a further favorable embodiment of the invention, the baffle plate is made of two parts of the peripheral wall that are partially detached from the peripheral wall and connected to the peripheral wall at a bending point in each case; the parts are bent inwards towards the exhaust gas stream at their bending point and meet at a joint to form the baffle plate. This embodiment can be manufactured in an especially simple way.

In especially favorable further embodiments, the two parts are lock-beaded to one another at the joint. They could also be bonded to one another, and thus preferably soldered or welded, at the joint in accordance with a further favorable embodiment.

Another very favorable embodiment of the invention provides for the joint to be located outside of the center of the exhaust gas stream so that the connection point at the joint between the two parts forming the baffle plate is not subjected to an excessive thermal and mechanical load.

Another very favorable embodiment of the invention is characterized in that the baffle plate has a diameter that is greater than the peripheral wall of the exhaust gas recirculation tube.

The process in accordance with the invention is characterized by the process steps that a part of the peripheral wall will be detached at least partially from the peripheral wall at the gas outlet end of the exhaust gas recirculation tube, wherein the part will remained connected with the peripheral wall on at least one bending edge and the baffle plate will be formed from the part.

A process in accordance with the invention in a further favorable embodiment in which the part forming the baffle plate is cut out of the tube wall is very easy to realize. In so doing, the part forming the baffle plate can be cut out of the peripheral wall by means of a laser-cutting process or water-jet cutting.

A favorable variation of the process in accordance with the invention in which the part forming the baffle plate is stamped out of the peripheral wall can also be very easily applied.

BRIEF DESCRIPTION OF THE DRAWINGS

Further advantages and characteristics of the invention follow from the claims and from the description below, in which examples of the invention are explained in detail with a reference to the drawings. The following are shown here:

DETAILED DESCRIPTION OF THE DRAWINGS

Components and parts that correspond to one another are identified with the same reference numbers in the figures.

Figure 1:
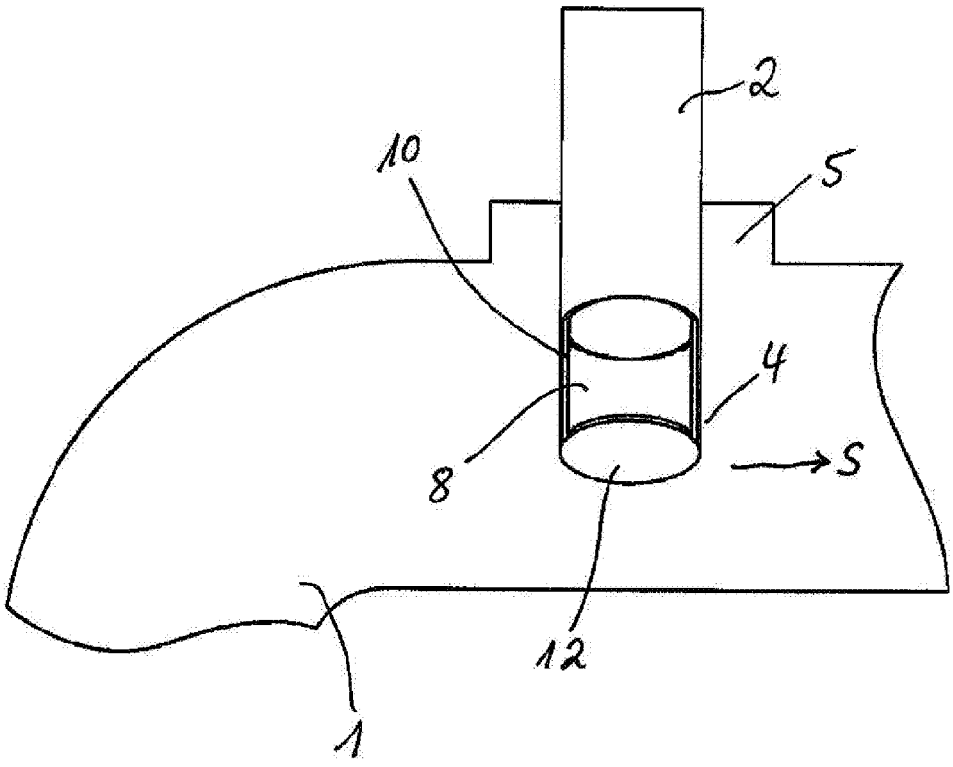
FIG. 1 shows a first device for exhaust gas recirculation in accordance with the invention.

FIG. 1 will now be considered to start with. FIG. 1 shows an intake module 1 in the form of an intake manifold into which a device in accordance with the invention with an exhaust gas recirculation tube 2 is inserted through a so-called EGR bell 5 downstream of the curvature of the intake manifold 1 and perpendicular to its axis in this area. The direction of flow of the exhaust gas stream in the intake manifold 1 is indicated with the arrow S. The intake manifold 1 is made of plastic.

Openings 8 are formed at the gas outlet end 4 of the exhaust gas recirculation tube 2 to the effect that parts of the peripheral wall remain in place as bars 10. A baffle plate 12 is put on the free ends of the bars 10 and soldered on or otherwise connected to them. The baffle plate 12 can be a separate part, for example a stamping. The recirculated exhaust gas from the gas outlet end 4 of the exhaust gas recirculation tube 2 can escape through the openings 8 between the bars 10, and the baffle plate 12 prevents the hot, recirculated exhaust gas from coming into contact with the opposite wall of the intake manifold 1.

The device for exhaust gas recirculation in accordance with the invention could be individually constructed in one of the ways described below.

Figure 2C:
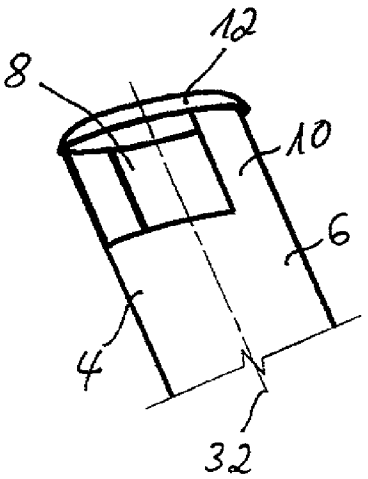
FIG. 2*a-c* shows a first embodiment in accordance with the invention of the gas outlet end of the exhaust gas recirculation tube.
Figure 2B:
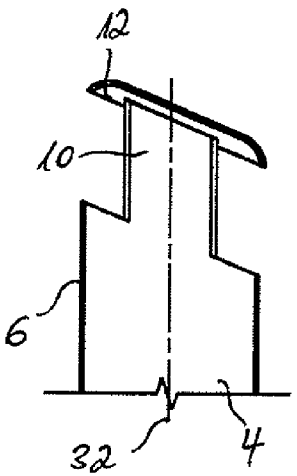
Figure 2A:
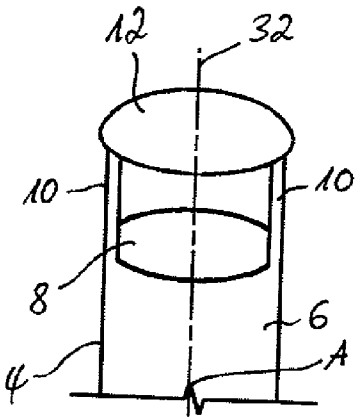

The gas outlet end 4 of an exhaust gas recirculation tube that projects into the intake module in accordance with FIG. 1 is shown in FIG. 2*a*. The gas outlet end 4 is provided with openings 8 in the wall 6, wherein bars 10 stay in place. A baffle plate 12 is put onto, and fastened to, the free ends of the bars 10 as a further separate component. The bars 10 roughly run in the longitudinal direction of the exhaust gas recirculation tube and roughly in parallel to its longitudinal axis.

The baffle plate 12 is a pure cut-out or stamped-out part that could also be deep-drawn at its edges, as indicated in the view of FIGS. 2*b* and 2*c*. The baffle plate 12 is connected in the form of a bond to the free ends of the bars 10, for instance via welding or soldering.

Thus, only two work steps are necessary to provide the gas outlet end 4 of the exhaust gas recirculation tube with a baffle plate 12 that prevents the hot, recirculated exhaust gas stream from coming into unobstructed contact with the wall of the intake module: putting the openings in the wall 6 and attaching the baffle plate 12.

FIG. 2*b* shows a view of the embodiment in accordance with FIG. 2*a* from a different direction. The view here is of the broad side of one of the two bars 10; the opening 8 is concealed by the bar 10 in this view. One can also see that the baffle plate 12 is put on the free ends of the bars 10 at a slant. Its surface normal forms an acute angle with the longitudinal axis 32 of the gas outlet end 4 of the exhaust gas recirculation tube.

The baffle plate 12 can be arranged in a perpendicular fashion as a general principle or else with a slope along the axis A of the exhaust gas recirculation tube (surface normal of the baffle plate in parallel or with a slope vis-à-vis the axis A).

FIG. 2*c* shows a perspective view of the gas outlet end 4 of the exhaust gas recirculation tube.

FIGS. 3 to 8 show variations of a further embodiment in which a part of the peripheral wall is partially detached from the peripheral wall 6 at the gas outlet end 4 of the exhaust gas recirculation tube 2, but remains connected to the peripheral wall at a bending edge, and is then bent in such a way that the baffle plate is formed from the part that is partially detached from the peripheral wall. A joining operation is no longer required in this construction operation, because the baffle plate directly formed from the peripheral wall is already connected to the peripheral wall at the bending edge. It has to merely be fixed in place on the side opposite the bending edge on the peripheral wall of the exhaust gas recirculation tube so that it does not fold back or fold away and release the exhaust gas stream in operation when the hot exhaust gas flows against it at a high speed.

Figure 3B:
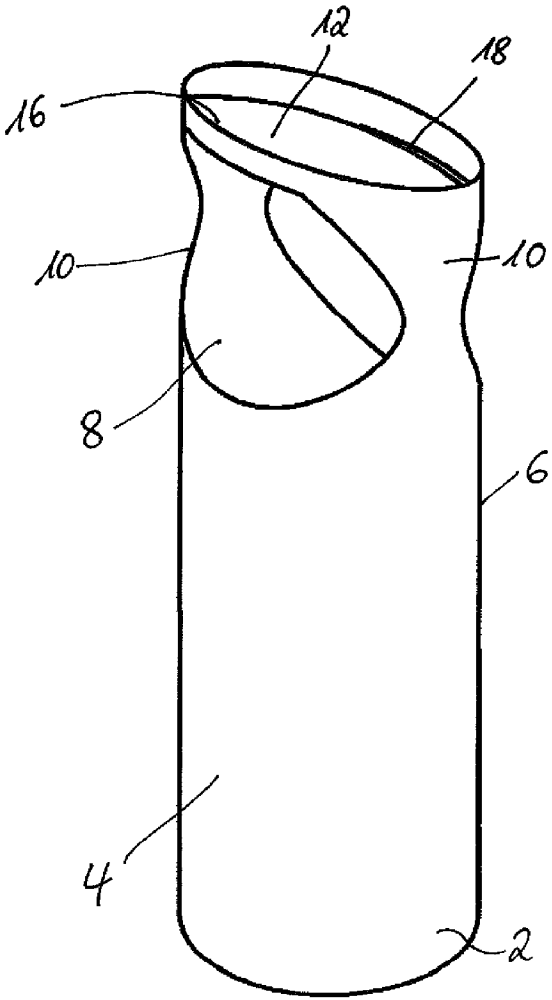
FIG. 3*b* shows a second embodiment of the gas outlet end of the exhaust gas recirculation tube in accordance with the invention.
Figure 3A:
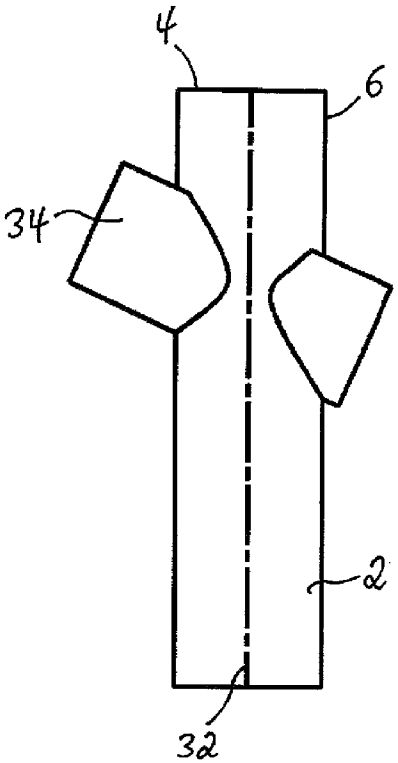
FIG. 3*a* schematically shows a preliminary stage in the production of a second embodiment of the gas outlet of the exhaust gas recirculation tube in accordance with the invention.

In the variation shown in FIGS. 5*a* and 3*b*, a cover is partially stamped out with a stamping tool 34 crosswise to the longitudinal axis 32 of the exhaust gas recirculation tube 2 and set up in the exhaust gas stream via bending so that the gas outlet end 4 of the exhaust gas recirculation tube 2 is closed by a baffle plate 12 formed from the cover that is set up. Openings 8 through which the hot exhaust gas can escape without directly making contact with the wall of the intake module arise in the peripheral wall of the gas outlet end via the stamping process.

A limit stop 18 is molded for the cover on the side opposite the bending edge of the cover to keep the baffle plate 12 from folding back.

The covering part 14 can also be completely separated from the cylindrical-shell-shaped conduit of the tube 4 as a general principle, formed to be flat if necessary, put on the face of the tube 4 and connected in the form of a bond (soldering, welding).

Figures 7A, 7B, 8A, 8B:
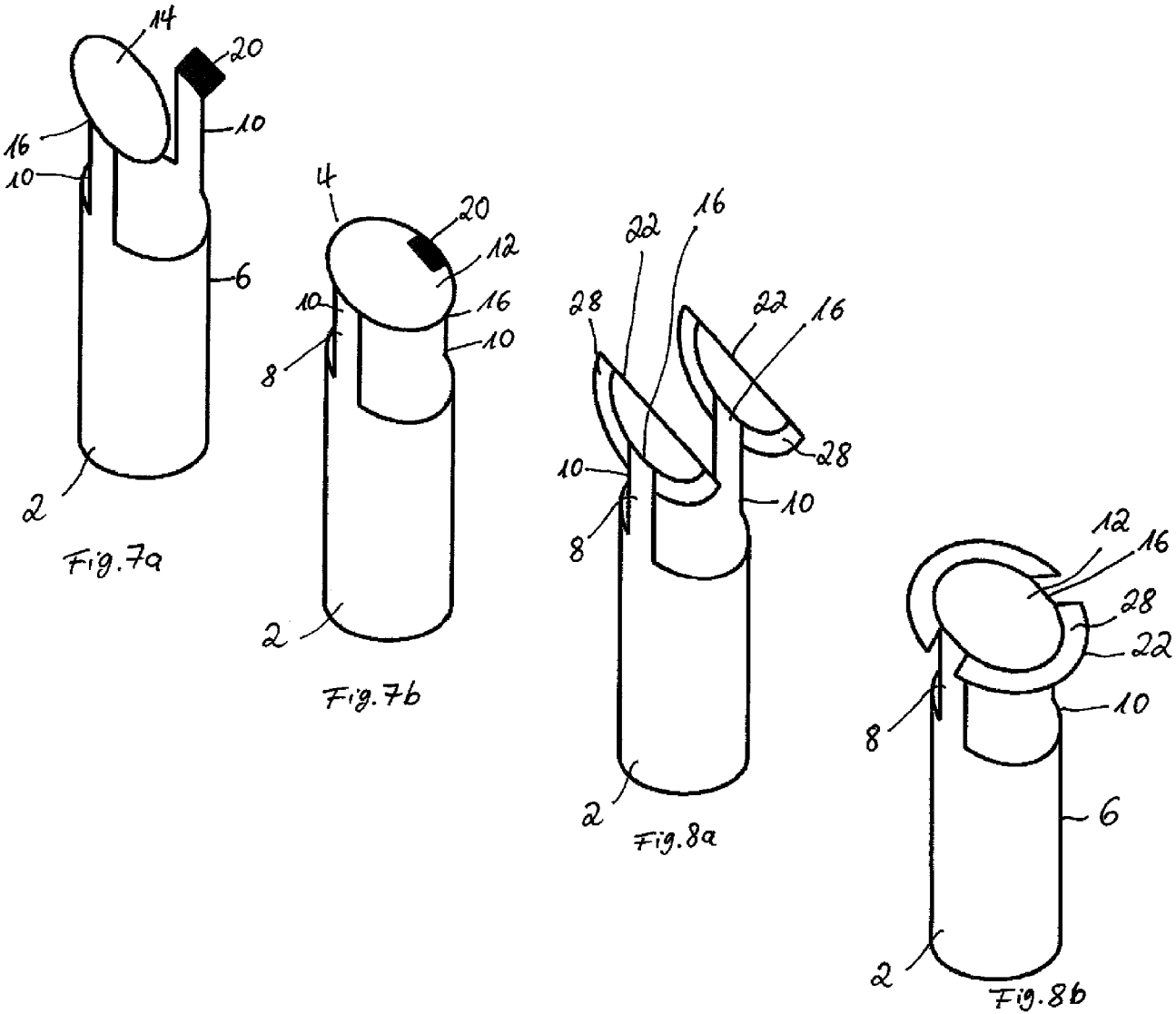
FIG. 7*a* schematically shows a preliminary stage in the production of a sixth embodiment of the gas outlet of the exhaust gas recirculation tube in accordance with the invention.
FIG. 7*b* shows a sixth embodiment of the gas outlet end of the exhaust gas recirculation tube in accordance with the invention.
FIG. 8*a* schematically shows a preliminary stage in the production of a seventh embodiment of the gas outlet of the exhaust gas recirculation tube in accordance with the invention.
FIG. 8*b* shows a seventh embodiment of the gas outlet end of the exhaust gas recirculation tube in accordance with the invention.

FIGS. 7*a* and 7*b* show another variation of this embodiment. The gas outlet end of the exhaust gas recirculation tube 2 is stamped out in such a way here that two opposing bars 10 remain. A cover part 14 that stays connected to the bar 10 via a bending edge 16 remains on one of the bars. A retaining tab 20 is left in place on the other bar. The situation after the bending of the cover part 14 in the direction of the gas stream is shown in FIG. 7*b*. The cover part 14 now constitutes a baffle plate 12 for the hot, recirculated exhaust gas stream and is supported on the free end of the bar opposite the bending edge 16. The retaining tab 20 is bent in the direction of the baffle plate 12 and keeps it in its position like a holding claw. A joining operation, for example soldering or spot welding, is not necessary; the baffle plate 12 is held in its operating position by the bending operations alone.

Figures 4A, 4B, 4C, 4D, 5:
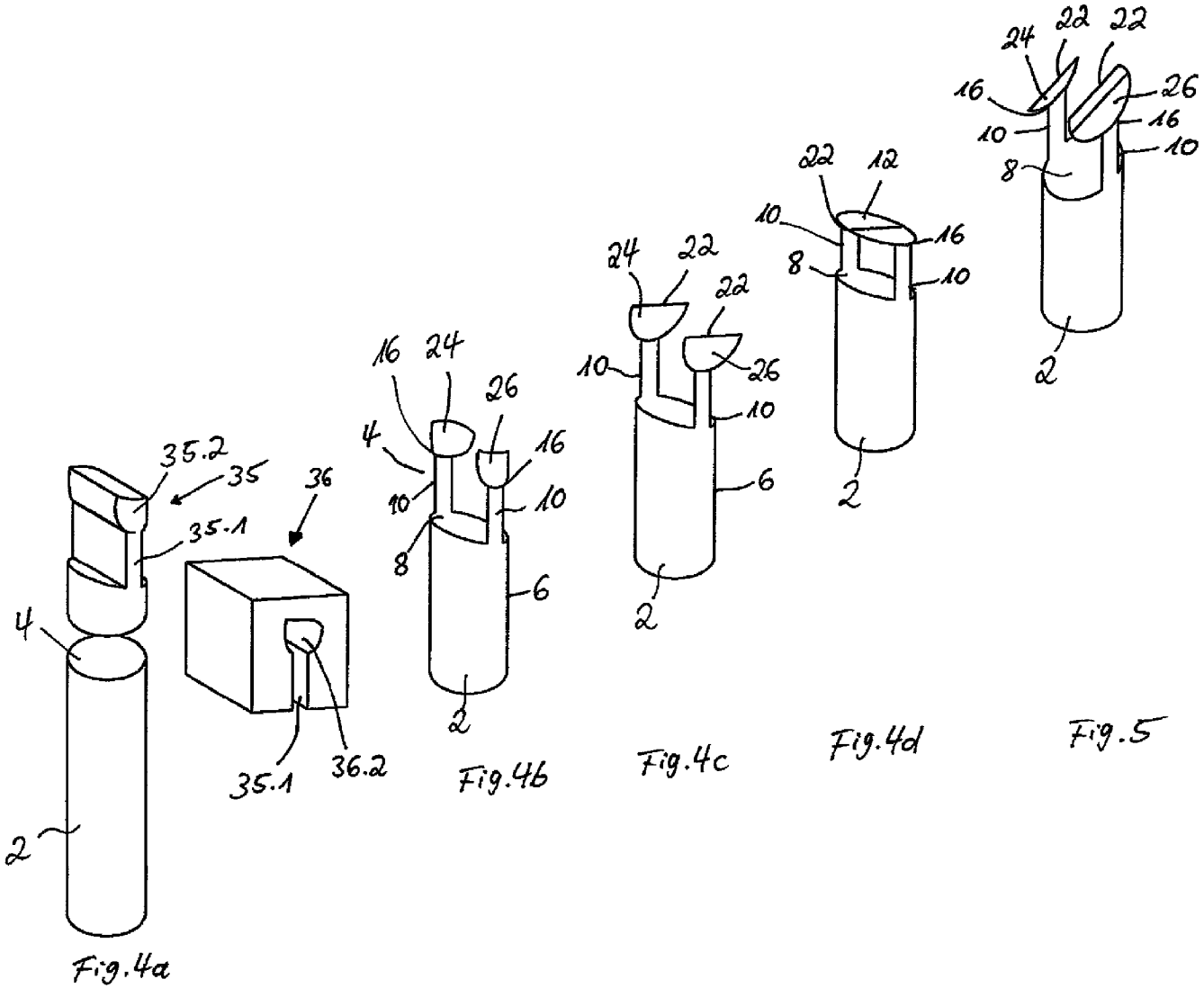
FIG. 4*a-c* schematically shows preliminary stages in the production of a third embodiment of the gas outlet of the exhaust gas recirculation tube in accordance with the invention.
FIG. 4*d* shows a third embodiment of the gas outlet end of the exhaust gas recirculation tube in accordance with the invention.
FIG. 5 schematically shows a preliminary stage in the production of a fourth embodiment of the gas outlet of the exhaust gas recirculation tube in accordance with the invention.

A further variation is shown in various stages of production in FIGS. 4*a* to 4*d*. FIG. 4*a* shows the starting situation, the gas outlet end 4 of the exhaust gas recirculation tube 2.

A bracing tool 35 first moves on an axial basis into the cylindrical-shell-shaped basic part 2 of a taper 35.1 in the area of the bars 10 and an enlargement 35.2 in the area of the partial plates 24, 26 to stamp out the openings and expose the bars 10 and partial plates 24, 26 of the baffle plate. After that, another stamping tool 36 moves at the level of the first tool 35 on a cross-wise basis through the basic part (and thus perpendicular to its axis), wherein this stamping tool has a continuous structure that likewise has a taper 36.1 in the area of the taper 35.1 of the bracing tool 35 and therefore the bars, and likewise has an enlargement 36.2 in the area of the enlargement 35.2 and therefore the partial plates 24, 26; they correspond to the taper 35.1 and the enlargement 35.2 in each case.

How two bars 10 detached from the gas outlet end of the peripheral surface 6 of the exhaust gas recirculation tube stay in place after the stamping cross-wise to the longitudinal axis of the exhaust gas recirculation tube, how partial plates 24, 26 likewise stayed in place at their free ends in each case and how they remained connected with the free ends of the bars 10 via bending edges 16 are shown as the next step in FIG. 4*b*. The partial plates 24, 26 still have the surface curvature of the peripheral surface of the exhaust gas recirculation tube 2 in the stage shown in FIG. 4*b*, whereas a situation is shown in FIG. 4*c* in which the partial plates 24, 26 have been formed to be flat.

Finally, the situation in which the two partial plates 24, 26 are folded over or bent crosswise in the direction of the exhaust gas stream and their abutting edges 22 meet in roughly the middle of the exhaust gas stream is shown in FIG. 4*d*. A continuous baffle plate 12 arises because of that from the two partial plates 24, 26 that are folded over crosswise, and an opening 8 remains free between the bars 10 for the hot exhaust gas flowing out.

The two partial plates 24, 26 are connected to one another at the joint edges 22 where they meet by lock-beading or spot welding or another joining operation for reasons involving the mechanical stabilization of the baffle plate 12.

Another variation is shown in FIG. 5. The joint of the two partial plates 24, 26 is moved out of the center there to get out of the middle of the hot exhaust gas stream. This is done by stamping out the partial plates 24, 26 in a non-symmetrical way. The first partial plate 26 is then bigger than the second partial plate 24, so the abutting edges 22 meet outside of the center of the tube.

Figure 6:
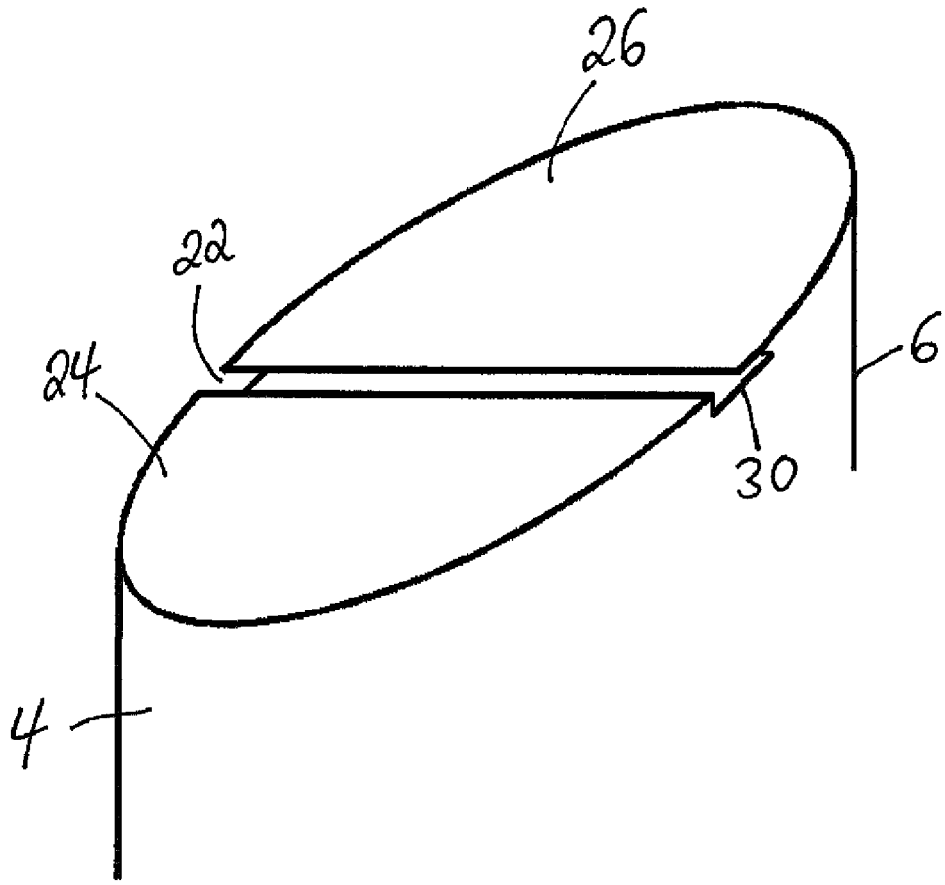
FIG. 6 shows a fifth embodiment of the gas outlet end of the exhaust gas recirculation tube in accordance with the invention.

A further variation is shown in FIG. 6. The two partial plates 24, 26 are designed to overlap in the joint area there. An overlapping strip 30 is left in place on the second partial plate 24 that reaches under the first partial plate 26 in a stepped fashion after the bending of the two partial plates 24, 26. The two partial plates 24, 26 can be additionally connected to one another in a solid way via spot welding, soldering or another joining operation in the area of the overlapping strip 30 in this position. Further mechanical reinforcement is obtained at the joint in the area of the abutting edges because of the overlapping strip 30.

The diameter of the baffle plate 12 corresponded to the interior diameter of the exhaust gas recirculation tube at its gas outlet end in the variations previously described. According to a further variation shown in FIGS. 8*a* and 8*b*, it is also conceivable for the diameter of the baffle plate 12 to be greater than the interior diameter of the exhaust gas recirculation tube 2 at its gas outlet end. The partial plates 24, 26 are separated from the peripheral wall 6 of the exhaust gas recirculation tube with a circumferential collar for this. After the bending, the collar 28 causes the baffle plate 12 to project beyond the exhaust gas recirculation tube 2 in terms of the circumference.

When the separation of the part(s) or partial plate(s) 14, 24, 26 from the peripheral wall at the gas outlet end of the exhaust gas recirculation tube via stamping was described in the description above, this is not intended to have a limiting effect. Rather, all other known separation operations in the area of metalworking could be applied, especially cutting techniques such as laser cutting or water-jet cutting, for instance.

The invention claimed is:

1. A device for exhaust gas recirculation of a combustion engine with an intake module, the device comprising:

an exhaust gas recirculation tube comprising a gas outlet end for projecting into an exhaust gas stream, wherein openings are created in a peripheral wall of the gas outlet end of the exhaust gas recirculation tube, wherein peripheral wall parts stay in place as bars to which a baffle plate is coupled for the exhaust gas stream, said baffle plate being a separate component and said baffle plate being connected in a form of a bond to free ends of the bars.

2. A device according to claim 1, wherein the baffle plate is soldered or welded to the free ends of the bars.

3. A device according to claim 1, wherein the baffle plate has a greater diameter than the peripheral wall of the exhaust gas recirculation tube.

4. A process for manufacturing an exhaust gas recirculation unit the process comprising:

providing an exhaust gas recirculation tube comprising a peripheral wall and a gas outlet end, wherein a part of the peripheral wall is at least partially detached from the peripheral wall at the gas outlet end, wherein the part remains connected to the peripheral wall on at least one bending edge and the baffle plate is formed from the part, wherein one bar each running in an axial direction with a partial plate connected thereto on a bending edge is cut out or stamped out on opposite sides of the peripheral wall at the gas outlet end of the exhaust gas recirculation tube, and the partial plates are subsequently bent around the bending edge so that the partial plates come to rest crosswise to the direction of flow and complement one another at abutting edges to form the baffle plate for an exhaust gas stream.

5. A process according to claim 4, wherein the partial plates are lock-beaded or welded at the abutting edges.

6. A process according to claim 4, wherein the partial plates are cut out or stamped out to be so large that the partial plates overlap in the area of the abutting edges.

7. A device for exhaust gas recirculation of a combustion engine with an intake module, the device comprising:

an exhaust gas recirculation tube comprising a gas outlet end for projecting into an exhaust gas stream, wherein openings are created in a peripheral wall of the gas outlet end of the exhaust gas recirculation tube, wherein peripheral wall parts stay in place as bars to which a baffle plate is coupled for the exhaust gas stream, said baffle plate comprising at least one part that is partially detached from the peripheral wall and said at least one part remains connected to the peripheral wall at a bending point, wherein the part that is partially detached from the peripheral wall is bent away from the peripheral wall in the direction of the gas outlet end of the exhaust gas recirculation tube in such a way that said at least one part acts as the baffle plate.

8. A device according to claim 7, wherein the peripheral wall has a limit stop for the detached part of the peripheral wall that constitutes the baffle plate.

9. A device according to claim 8, wherein a retaining tab for holding the detached and bent part of the peripheral wall is provided on the side of the peripheral wall opposite the bending point.

10. A device according to claim 7, wherein the baffle plate is made of two parts of the peripheral wall that are partially detached from the peripheral wall and connected to the peripheral wall at a bending point in each case, which are bent inwards towards the recirculated exhaust gas stream at their bending point and meet at a joint to form the baffle plate.

11. A device according to claim 10, wherein the two parts are lock-beaded, soldered or welded to one another at the joint.

12. A device according to claim 10, wherein the two parts are connected in the form of a bond to one another at the joint.

13. A device according to claim 10, wherein the joint is located outside of the center of the recirculated exhaust gas stream.

14. A process for manufacturing an exhaust gas recirculation unit, the process comprising:

providing an exhaust gas recirculation tube comprising a peripheral wall and a gas outlet end, wherein a part of the peripheral wall is at least partially detached from the peripheral wall at the gas outlet end, wherein the part remains connected to the peripheral wall on at least one bending edge and the baffle plate is formed from the part, wherein the part of the peripheral wall is cut out or stamped out at the gas outlet end crosswise to the longitudinal axis of the exhaust gas recirculation tube and the part of the peripheral wall remains connected to the peripheral wall on the at least one bending edge and the part is set up by bending around the bending edge so that the part forms the baffle plate for an exhaust gas stream.

15. A process according to claim 14, wherein the part forming the baffle plate is stamped out of the peripheral wall.

16. A process according to claim 14, wherein a first bar running in an axial direction with a partial plate connected thereto on a bending edge and a second bar running in an axial direction with a retaining tab thereon are cut out or stamped out on opposite sides of the peripheral wall at the gas outlet end of the exhaust gas recirculation tube and the partial plate is held in place by the retaining tab after the bending.

17. A process according to claim 14, wherein the part forming the baffle plate is cut out.

18. A process according to claim 17, wherein the part forming the baffle plate is cut out of the peripheral wall by means of a laser-cutting process or water-jet cutting.

* * * * *